US007798781B2

(12) United States Patent
Parsons et al.

(10) Patent No.: US 7,798,781 B2
(45) Date of Patent: Sep. 21, 2010

(54) METERING PUMP WITH SELF-CALIBRATION AND HEALTH PREDICTION

(75) Inventors: Douglas A. Parsons, Canton, CT (US); Kevin E. Alstrin, Windsor, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 916 days.

(21) Appl. No.: 11/359,191

(22) Filed: Feb. 22, 2006

(65) Prior Publication Data

US 2007/0196213 A1 Aug. 23, 2007

(51) Int. Cl.
*F04B 49/00* (2006.01)

(52) U.S. Cl. ..... 417/20; 417/44.2; 417/43

(58) Field of Classification Search ..... 418/18, 418/44.11, 15, 38; 417/20, 43, 44.1, 44.2; 123/497, 446, 198 D, 198 DB; 700/1, 9, 700/28, 32, 90, 231, 240, 244, 299, 305; 702/33, 34, 50, 51, 85, 100, 127, 182, 188, 702/189

See application file for complete search history.

(56) References Cited

U.S. PATENT DOCUMENTS 5,112,196 A * 5/1992 Schuh ..... 417/63
5,941,305 A * 8/1999 Thrasher et al. ..... 166/53
6,171,065 B1 * 1/2001 Wode ..... 417/32
6,986,646 B2 * 1/2006 Bettenhausen et al. ..... 417/53
2003/0223877 A1 * 12/2003 Anstine et al. ..... 417/18
2004/0126243 A1 * 7/2004 Sievert et al. ..... 417/44.2
2005/0063828 A1 * 3/2005 Kim ..... 417/32
2005/0111988 A1 * 5/2005 Griffiths ..... 417/53
2005/0123408 A1 * 6/2005 Koehl ..... 417/53
2005/0284214 A1 * 12/2005 Gustafson et al. ..... 73/116
2008/0181789 A1 * 7/2008 Koehl ..... 417/44.11

* cited by examiner

*Primary Examiner*—Devon C Kramer
*Assistant Examiner*—Todd D Jacobs
(74) *Attorney, Agent, or Firm*—Carlson, Gaskey & Olds

(57) ABSTRACT

A metering pump incorporates a method of relating inner loop current to a pump output pressure. Pump/motor speed, which correlates to current, is measured and controlled by a system controller. System temperature is also measured by the system controller. The controller monitors the measured system temperature and provides for compensation for system losses, including inductive-resistive (IR) losses, and for density and viscosity shifts, within a pre-determined allowable system temperature operating range. An initial system calibration is conducted using a "shut-off" test, where the metering pump is run at a very slow known speed while the system is shut-off. After initial start-up, a health-monitoring feature continues to monitor the current as an indicator of pump performance and continuously adjusts a motor speed to maintain a desired level of pump performance. This provides the system with the ability to compensate for performance losses, including performance losses due to variations in operating conditions, and to compensate for pump wear.

23 Claims, 1 Drawing Sheet

METERING PUMP WITH SELF-CALIBRATION AND HEALTH PREDICTION

BACKGROUND OF THE INVENTION

This application relates generally to a metering pump for gas turbine engine that includes a method of self-calibration and health-monitoring.

A demand flow system traditionally includes a controller, a motor and a pump. The demand flow system functions as a metering system to regulate fuel delivery to, for example, a gas turbine engine. Fuel regulation is traditionally accomplished by direct control of the pump, also known as a metering pump. The metering pump includes a motor, where speed is varied to provide a desired flow. The effectiveness of the demand flow system is dependent on the accuracy of the control of the motor and the tolerances of the pump.

Known demand flow systems are typically calibrated only upon initial manufacture. However, a primary problem associated with known demand flow systems is system accuracy, which includes both determining system accuracy at an initial system start-up and monitoring system accuracy or "health" throughout the life of the system. Because the systems are calibrated at initial manufacture, and due to system variations based on allowable system tolerances and changes in the system operating environment, the demand flow system may not meet desired operational requirements throughout the life of the product.

Accordingly, it is desirable to provide a metering pump that is operable to self-calibrate at initial start-up and which includes a health-monitoring system that allows the system to monitor performance and re-calibrate to compensate for performance losses.

SUMMARY OF THE INVENTION

A metering pump of the present invention incorporates a method of relating inner loop current to pump output pressure for a demand flow system. It has been determined that a system current is proportional to a pump delivered pressure. Because each pump by design has pre-defined characteristics of backpressure and flow at a given speed, a relationship can be developed that can determine the operating condition or the "health" of the system by utilizing information such as the pump/motor speed, an operating temperature, and the system current, for example.

The pump/motor speed is measured and controlled by a system controller. A system temperature is also measured by the system controller. The controller monitors the measured system temperature and provides for compensation for system losses, including inductive-resistive (IR) losses, and for density and viscosity shifts, within a pre-determined allowable system temperature operating range. For demand flow systems including a metering pump of the present invention, the system controller uses a root mean square (RMS) method of current measurement to measure the current through an inner loop of the system. This is accomplished through either direct measurement or indirect measurement of the current by the system controller.

An initial calibration of the system is conducted using a "shut-off" test where the pump is at a very slow known speed while the system is shut-off. Under these conditions, the pump is "dead-headed" and the only "flow" is leakage. This allows the system to generate a base flow map. By incorporating a health-monitoring feature at this point, the base flow map can be adjusted, i.e. pump speed is increased or decreased from a flow request, to account for the measured leakage. After the appropriate adjustment has been made, the current is directly proportional to the pump performance.

After initial start-up, the health-monitoring feature continues to monitor the current as an indicator of pump performance and continuously adjusts motor speed to maintain a desired level of pump performance. This provides the system with the ability to compensate for performance losses, including performance losses due to variations in operating conditions, and to compensate for pump wear.

These and other features of the present invention can be best understood from the following specification and drawings, the following of which is a brief description.

DETAILED DESCRIPTION OF THE PREFERRED EMBODIMENT

Figure 1:
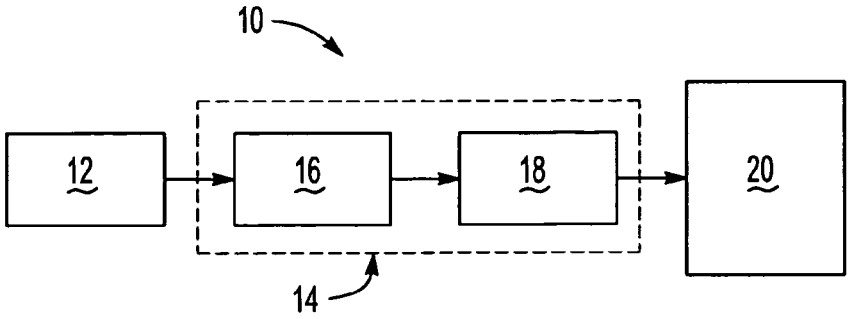
FIG. 1 illustrates an example demand flow system including a metering pump of the present invention.

FIG. 1 schematically illustrates an example demand flow system 10 including a metering pump 14 of the present invention. A system controller 12 controls a current transmitted to a motor 16. The motor 16 controls a pump 18, which provides a desired flow of fluid, e.g. fuel, to a device 20. In this example system 10, the device 20 is a gas turbine engine, however, the device 20 may be any device that requires regulated delivery of a fluid.

An amount of current transmitted to the motor 16 is directly related to a speed of the motor 16. The speed of the motor 16 is proportional to a pressure of a fluid delivered by the pump 18 to the gas turbine engine 20. The pressure of the fluid delivered by the pump 18 correlates to a flow of fluid from the pump 18 to the gas turbine engine 20. As such, a relationship exists between the amount of current transmitted to the motor 16 and the flow of fluid from the pump 18.

An initial calibration of the system is conducted using a "shut-off" test where the pump 18 is run at a very slow known speed while the system is shut-off. Under these conditions, the pump 18 is "dead-headed" and the only "flow" is leakage from the pump 18. This allows the system to generate a Base Flow Map (BFM). A health-monitoring feature is used to adjust the BFM by increasing or decreasing pump speed from a flow request, to account for the measured leakage. After the appropriate adjustment has been made, the current is directly proportional to the pump performance. Therefore, subsequent monitoring of the current is indicative of pump performance.

As such, after initial start-up, the health-monitoring feature continues to monitor the current as an indicator of pump performance and continuously adjusts motor speed to maintain a desired level of pump performance. This allows the system the ability to compensate for performance losses, including performance losses due to variations in operating conditions, and to compensate for pump wear. For example, when an actual measured pump leakage is greater than an expected pump leakage, the controller 12 will increase the current delivered to the motor 16, which in turn increases an actual flow delivered from the pump 18 to the gas turbine engine 20, to accommodate for the additional pump leakage. Conversely, when the actual measured pump leakage is less than the expected leakage, the controller 12 will decrease the current delivered to the motor 16, which in turn decreases the actual flow delivered from the pump 18 to the gas turbine engine 20. This adjustment is reflected in an adjusted BFM. The health-monitoring process is repeated continuously throughout the daily operation of the system 10 and throughout the life of the system 10.

Figure 2:
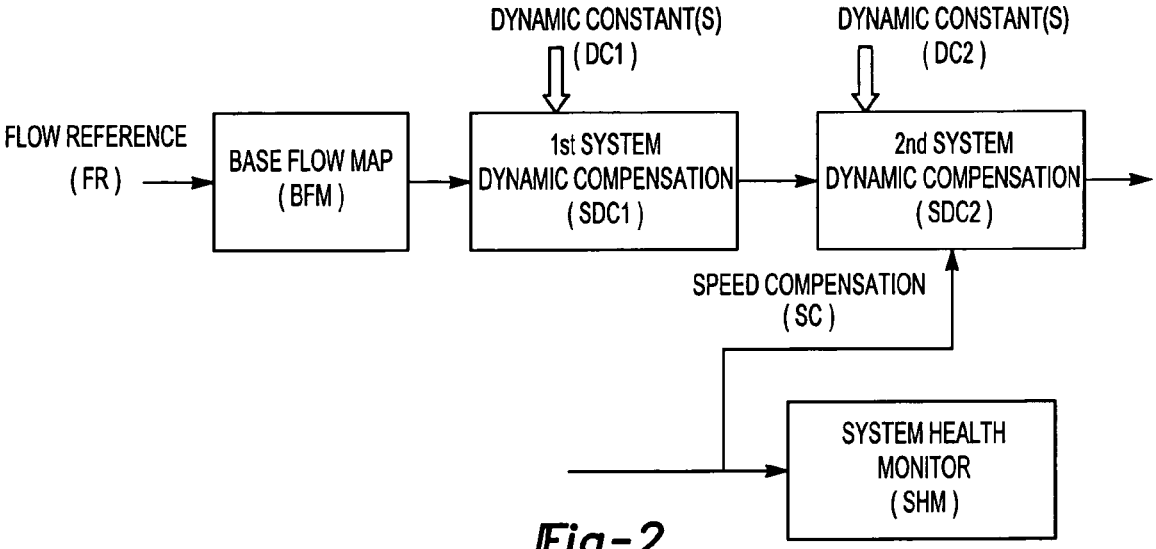
FIG. 2 schematically illustrates a method of self-calibration and dynamic system adjustment for a metering pump according to one embodiment of the present invention.

FIG. 2 schematically illustrates a method of self-calibration and dynamic system adjustment for a metering pump 14 according to one embodiment of the present invention. As illustrated in FIG. 2, a Flow Reference (FR) is utilized to generate an initial BFM. The FR is generated by the controller 12 based upon known system characteristics, for example, backpressure and/or flow, which are indicative of pump leakage. The BFM illustrates how the FR varies as a function of motor speed. As such, the BFM is used as a baseline for initial system performance.

While, the known system operating characteristics are dictated by the original system design, they can vary within the allowable design tolerances. As such, once the BFM has been determined and upon initial system start-up, a First System Dynamic Compensation (SDC1) is conducted. The SDC1 is an initial calibration stage conducted using the "shut-off" test as described above. Under these conditions, the pump 18 is "dead-headed" and the only "flow" is pump leakage. During the SDC1 calibration stage, the controller 12 adjusts the FR based upon a Dynamic Constant (DC1) to accommodate for a variation in system operating conditions. This allows the system 10 to conduct an initial self-calibration that includes adjusting the BFM based upon the actual system operating conditions by compensating for actual component tolerances, i.e. compensation for a tight pump or a loose pump.

In this example, the DC1 is initial pump leakage and the controller 12 adjusts the FR to account for deviation of an actual measured leakage measured from the initial pump leakage expected based upon the original FR. The original FR, which was generated based upon known system characteristics, is used to generate the BFM. However, as a result of design tolerances associated with assembly of the pump 18, the known system characteristics can vary within an allowable tolerance range based upon actual dimensions of the pump 18. The SDC1 calibration stage accommodates for this variation by determining the initial pump leakage, which is indicative of the tightness or looseness of the pump 18 as discussed above, and adjusting the BFM respectively by increasing or decreasing the pump speed associated with a desired flow request to account for the initial pump leakage and provide the desired flow regardless of the initial pump leakage.

Further, the system includes a Second System Dynamic Adjustment (SDC2) that operates continuously throughout system operation and functions as a health-monitoring system feature throughout the life of the system to accommodate for changes in the system operating conditions including component wear and environmental factors, e.g. temperature variation.

The SDC2 incorporates a health-monitoring relationship into the system. The health-monitoring relationship monitors an operating characteristic associated with the system and adjusts the operating characteristic to achieve and maintain a desired system operating function level. In the example system, the monitored operating characteristic is RMS current and the desired system operating function level is Normal System Function.

Figure 3:
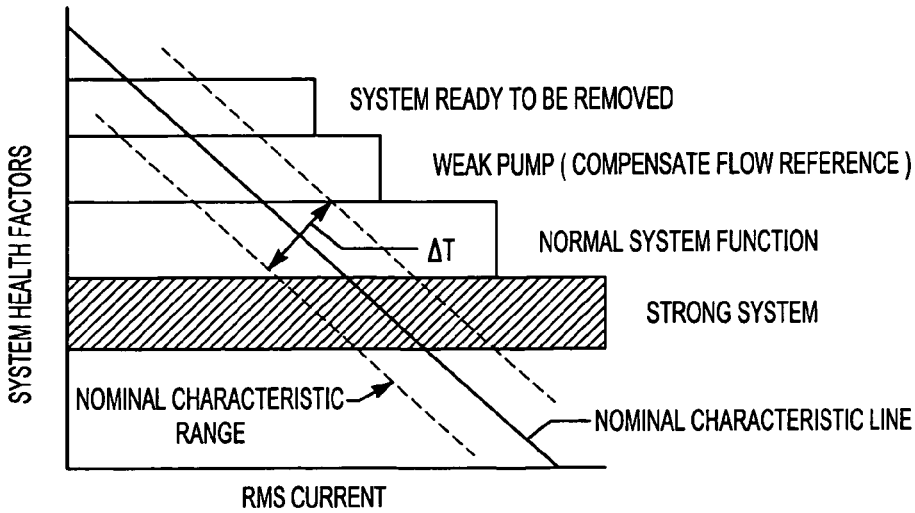
FIG. 3 graphically illustrates a health-monitoring relationship between system operating characteristics and system operating function levels according to one embodiment of the present invention.

FIG. 3 graphically illustrates an example of a health-monitoring relationship between system operating characteristics and system operating function levels according to one embodiment of the present invention. In this example system, the system operating characteristic is RMS Current, which is directly related to motor speed, and the System Health Factor is pump leakage, which is a function of system pressure.

A relationship is defined between the RMS Current and the pump leakage. A Nominal Characteristic line (NCL) is determined based upon the relationship and a Nominal Characteristic Range (NCR) is defined based as a function of system temperature variation. System Operating Function Levels (SOFL) are defined along the NCL. In this example system, the SOFL's include: Strong System, Normal System Function, Weak Pump, and System Ready to be Removed.

An initial SOFL is determined during initial calibration of the system. The initial SOFL is based upon the RMS current required to produce a desired flow at a nominal temperature and is adjusted during initial calibration to account for pump leakage associated with initial pump tolerances. The RMS current is directly related to motor speed. As such, if the initial SOFL is Strong System, then the controller will reduce the motor speed to produce the desired flow and reduce the SOFL to Normal System Function. Conversely, if the initial SOFL is below Normal System Function, then the controller will attempt to increase the motor speed to produce the desired flow and bring the SOFL up to Normal System Function.

An actual motor speed, system temperature and, the RMS current are continuously monitored throughout the daily operation of the system and throughout the life of the system. However, throughout the life of the system, pump wear is inevitable. As the pump 18 begins to wear, the pressure produced by the pump 18 decreases as does the flow delivered by the pump resulting in the pump 18 operating at the decreased SOFL of Weak Pump.

Because the pressure produced by the pump 18 is proportional the RMS current, as the RMS current decreases so does the pressure produced by the pump 18. As such, based upon the measured system operating temperature, the controller 12 will increase the motor speed to accommodate for pump wear to ensure the desired flow and the SOFL of Normal System Function are achieved. The increase in motor speed generates an increase in the current provided to the motor 16, and the increase in current is proportional to the pressure produced by the pump 18.

However, at some point during the life of the system, the SOFL will reach the last level—System Ready to be Removed, which indicates that the pump 18 has reached a critical wear level and the system is unable to accommodate for the losses at this level. That is, pump leakage within the system has reached a critical level and the pump should be replaced.

When the system encounters a SOFL other than Normal System Function, the system will notify the user and accommodate where possible. However, once the system reaches the last level—System Ready to be Removed, the system will shut-down and notify the user that the pump must be replaced.

Further, while the method of the present invention is discussed in relation to metering pumps, the method of the present invention is not limited to metering pumps, it may also be applied to pumps including other types of motors, for example, a switch-reluctance (SR) motor or "stepper" motor. In systems including the SR motor, phase current would be measured instead of RMS current. As such, although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of controlling a pumping system that includes a metering pump driven by a motor to deliver a desired flow of fuel to an engine, comprising the steps of:

(a) selecting and measuring a first system operating characteristic;

(b) selecting a system health factor that includes at least measured pump leakage initially determined by running the metering pump while the pumping system is shut-off;

(c) determining a system operating function level based upon a relationship between the first system operating characteristic and the system health factor;

(d) comparing the system operating function level to a desired system operating function level; and (e) adjusting a second system operating characteristic to achieve the desired system operating function level if the system operating function level is different than the desired system operating function level, wherein the second system operating characteristic comprises at least a motor speed that is continually adjusted to maintain a desired level of pump performance.

2. The method of claim 1, further including the step of determining a nominal value relationship between the first system operating characteristic and the system health factor.

3. The method of claim 2, wherein the pumping system includes a metering pump to deliver a desired amount of fuel to an engine, and further including measuring the pump leakage by running the metering pump while the pumping system is off and adjusting the nominal value relationship based upon measured pump leakage.

4. The method of claim 2, further including the step of determining a nominal value relationship range based upon the nominal value relationship and a pre-determined system operating temperature range.

5. The method of claim 1, further including the steps of measuring a system temperature, measuring the first system operating characteristic, measuring the second system operating characteristic and repeating step (c) through step (e).

6. The method of claim 5, wherein at least one of the first system operating characteristic and the second system operating characteristic is measured by direct measurement.

7. The method of claim 5, wherein at least one of the first system operating characteristic and the second system operating characteristic is measured based upon feedback generated by the motor.

8. The method of claim 1, wherein the first system operating characteristic is a system current.

9. The method of claim 8, wherein the system current is one of a root mean square current or phase current.

10. The method of claim 1, further including continuously repeating step (b) through step (e).

11. The method of claim 1, wherein the first system operating characteristic is a system current and the desired system operating function level is normal system function.

12. The method of claim 11, wherein step (e) further includes decreasing the motor speed based upon a nominal value relationship when a measured system temperature falls outside a pre-determined system operating temperature range and the system current exceeds a maximum value associated with the normal system function level.

13. The method of claim 11, wherein step (e) further includes increasing the motor speed based upon a nominal value relationship when a measured system temperature falls outside a pre-determined system operating temperature range and the system current falls below a minimum value associated with the normal system function level.

14. A demand flow system comprising:

a motor;

a metering pump driven by the motor, the metering pump to deliver a desired flow of fuel to an engine and wherein a speed of the motor is continually adjusted to maintain a desired level of pump performance; and a controller that determines a baseline system operating function level associated with a baseline flow of the metering pump wherein the baseline system operating function level is determined based upon a relationship between at least one measured system characteristic and a system health factor that includes at least a measured pump leakage comprising at least an initial pump leakage that is determined when the demand flow system is shut off and the metering pump is run at a slow known speed, and wherein the controller compares the baseline system operating function level to a desired system operating function level associated with a desired flow of the metering pump, initially adjusts at least one system operating characteristic comprising at least motor speed to achieve the desired system operating function level if the baseline system operating function level is different than the desired system operating function level, monitors an actual system operating function level during system use, and continues to adjust the system operating characteristic to maintain the actual system operating function level at the desired system operating function level by comparing the initial pump leakage to an initial flow reference to determine a difference, adjusting the motor speed to account for the difference, and subsequently monitoring motor current to identify a pump performance level.

15. The demand flow system of claim 14, wherein the at least one measured system characteristic comprises a system current and a system operating temperature.

16. The demand flow system of claim 15, wherein the controller decreases motor speed when a measured system operating temperature falls outside a pre-determined system operating temperature range and a measured system current is greater than a pre-determined maximum current.

17. The demand flow system of claim 15, wherein the controller increases motor speed when a measured system operating temperature falls outside a pre-determined system operating temperature range and a measured system current is less than a pre-determined minimum current.

18. The method of claim 1, including conducting an initial calibration with the pumping system shut-off and the metering pump being run at a slow known speed to measure the pump leakage, generating a base flow map based on measured pump leakage, and using a health-monitoring feature to adjust the base flow map by increasing or decreasing pump speed to account for the measured pump leakage.

19. The method of claim 1, including generating a flow reference based on known system characteristics, generating an initial base flow map based on at least the flow reference, and conducting a first system dynamic compensation to adjust the flow reference based on a dynamic constant that comprises an initial pump leakage with the flow reference being adjusted to account for deviation of an actual measured leakage.

20. A demand flow system comprising:

a motor;

a metering pump driven by the motor, the metering pump to deliver a desired flow of fuel to an engine and wherein a speed of the motor is continually adjusted to maintain a desired level of pump performance;

a controller that determines a baseline system operating function level associated with a baseline flow of the metering pump wherein the baseline system operating function level is determined based upon a relationship between at least one measured system characteristic and a system health factor that includes at least a measured pump leakage, and wherein the controller compares the baseline system operating function level to a desired system operating function level associated with a desired flow of the metering pump, initially adjusts at least one system operating characteristic comprising at least motor speed to achieve the desired system operating function level if the baseline system operating function level is different than the desired system operating function level, monitors an actual system operating function level during system use, and continues to adjust the system operating characteristic to maintain the actual system operating function level at the desired system operating function level; and wherein the controller conducts an initial calibration with the demand flow system shut-off and the metering pump being run at a slow known speed to measure pump leakage, generates a base flow map based on measured pump leakage, and uses a health-monitoring feature to adjust the base flow map by increasing or decreasing pump speed to account for the measured pump leakage.

21. The demand flow system of claim 14, including a base flow map based on known demand flow system characteristics and an adjusted base flow map based on an initial calibration of the demand flow system to account for pump leakage.

22. The demand flow system of claim 14, including a flow reference based on known demand flow system characteristics, an initial base flow map based on the flow reference, a system dynamic compensation based on an initial calibration of the metering pump and a measured dynamic constant including measured pump leakage, an adjusted base flow map based on the system dynamic compensation, and a system dynamic adjustment that continuously monitors the system operating characteristic as compared to the adjusted base flow map such that motor speed is continually adjusted to maintain the desired system operating function level.

23. The method of claim 1, including running the metering pump at a slow known speed while the pumping system is shut off to determine an initial pump leakage; comparing the initial pump leakage to an initial flow reference to determine a difference; adjusting the motor speed to account for the difference; and subsequently monitoring motor current to identify a pump performance level.

* * * * *